US005102362A

United States Patent [19]

Denen

[11] Patent Number: 5,102,362

[45] Date of Patent: Apr. 7, 1992

[54] GENERAL PURPOSE ILLUMINATOR ASSEMBLY

[75] Inventor: Dennis J. Denen, Columbus, Ohio

[73] Assignee: Progenics Corporation, Columbus, Ohio

[21] Appl. No.: 694,243

[22] Filed: May 1, 1991

Related U.S. Application Data

[62] Division of Ser. No. 606,119, Oct. 31, 1990, Pat. No. 5,058,900.

[51] Int. Cl.[5] ..... H01R 43/28

[52] U.S. Cl. ..... 445/22; 140/71 R

[58] Field of Search ..... 445/22; 339/715, 611, 339/613; 140/71 R

[56] References Cited

U.S. PATENT DOCUMENTS 3,026,936 2/1962 Bracci ..... 140/71 R 3,147,779 9/1964 Brown ..... 140/71 R

*Primary Examiner*—Kenneth J. Ramsey

*Attorney, Agent, or Firm*—Mueller and Smith

[57] ABSTRACT

An illuminator assembly is disclosed which is formed from a light emitting diode (LED) having two electrode pins extending therefrom which are cut to predetermined lengths. One lead then is formed to provide a circularly shaped spring support base and the other lead is bent to provide an attachment portion extending through the center of the opening formed by the spring support base. A capture spring of conical configuration then is attached to the centrally disposed lead which extends through the spring support base opening. A compressible coil switching spring then is attached to the spring support base. The assemblage thus formed is employed with a battery of a variety having a forward face which engages the free end of the switching spring and which includes a rod shaped electrode extending from the center portion thereof. Upon providing relative mutually approaching movement of a battery and illuminator assembly, the rod-like cathode is engaged by the capture spring and an electrical circuit is completed to illuminate the LED. Conversely, the releasing or reverse movement under the drive imparted by the switching spring switches the assemblage to an open circuit condition.

5 Claims, 5 Drawing Sheets

110
127
128
122
124
138
72
126
140
11
152
134
154
142
132
143
120
150
74
76
116
129
11
118
145
144
136
114
112

72
110
140
143
122
76
144
154
145
152
142
148
138
124
74
136
50
116
114
134
112
132

GENERAL PURPOSE ILLUMINATOR ASSEMBLY

This application is a division, of application Ser. No. 07/606,119, filed Oct. 31, 1990, now U.S. Pat. No. 5,058,900.

BACKGROUND OF THE INVENTION

A broad variety of utilitarian novelty and recreational implements have been proposed or introduced over the past which, in one way or another, feature some form of battery powered illumination. In general, these devices have resorted to overly complex and impractical illumination schemes which involve switching structures and associated wiring providing for supplying battery power to the light source. For the most part, the need to carry out a switching function has both exascerbated product cost and has imposed unfortunate limits upon desired miniaturization.

The light emitting diode (LED) has become a popular light source for miniature devices. However, the diodes are fabricated with rather robust dual pin electrodes which are designed for insertion and supportive mounting within structures such as circuit boards and the like. The devices, for example, are not generally available having low cost light socket base configurations or the like. Thus, the designer of small illuminated implements faces the task of providing a reliable electrical connection with the diode electrode pins, as well as implementing a practical switching function while achieving a structure which is practical to manufacture at high quantity levels and correspondingly at lower costs.

Applications for which a practical illuminator assembly have been sought include, for example, recreational darts, novelty pins, fishing bobbers, glow sticks, toy applications, and a wide variety of other items. The implementation, for example, of an implement illuminator assembly with recreational darts poses particular design difficulties. Typically, the recreational dart is formed having a body portion of relatively small diameter to which a point is attached at the front end and a flight containing tail feathers is attached at the rearward end of the body. To illuminate the flight with an LED requires, for example, that the body be configured having an internal chamber to carry a battery as well as the LED and appropriate switching. The LED then may illuminate the flight once the switch is turned on. The use of externally disposed switches is highly impractical, essentially precluding the introduction of the dart structures. Of further note, when the relatively heavier material of the dart body, which may be formed, for example of steel tungsten or the like, is hollowed to receive a light generating assemblage, the dart loses weight to the extent hat its weight is below that considered appropriate by serious dart recreationists, for example below about 26 gm.

In view of the foregoing, an illuminator assembly which exhibits a capability for very large volume fabrication at low cost and which is capable of forming a reliable electrical circuit to a light emitting diode under wide fabricational tolerances and with a simplicity of switching actuation could find a high level of acceptance in a broad variety of industries.

SUMMARY

The present invention is addressed to an illuminator assembly, implement and method of manufacture of the illuminator assembly which provides a highly effective and reliable implement illumination feature with facile production procedures. The assembly performs in conjunction with a small, lithium pin battery which has a cylindrical, electrodefining outer surface extending to and somewhat over a forward face. From the forward face there extends a rod-shaped electrode. This battery is employed with a dual spring based contact and switching configuration formed in conjunction with the electrode pins of a light emitting diode (LED). One electrode pin of the light emitting diode is formed to define a circular spring support base having an opening therein. The second electrode pin of the diode is formed so that a mounting portion is developed which extends essentially through the opening in the spring support base. A small, conically shaped capture spring is attached to the mounting portion of the electrode extending through the spring support base, while a larger switching spring is attached to the spring support base formed from the other electrode pin. The switching spring has a diameter selected to provide electrical contact with the forward face of the battery and the capture spring is retained within the inner diameter of the switching spring. Thus, by simply contacting the switching spring with the battery forward face and providing a relative motion between the diode and the battery to thus compress the switching spring, the rod-shaped electrode of the battery will move toward and be captured in a reliable electrical connection with the capture spring to illuminate the diode. No extraneous switching schemes are utilized, and the illuminator assembly thus developed is amenable to high production techniques and further complements efficient production techniques for fabricating the implements within which it and a battery are utilized.

Another feature of the invention is to provide an illuminator assembly for use with a battery of given outer diameter and having a centrally disposed rod-shaped electrode extending outwardly from the forward face thereof a predetermined length. The assembly includes a light emitting diode having first and second thin metal electrode pins extending from a back surface thereof, the first pin extending rearwardly from the back surface to a base position and is configured thereat to define a spring support base disposed along a plane generally parallel with the back surface and having a base opening therein. The second electrode pin is configured to extend to and provide a mounting portion located at the center of the base opening. A compressible coil switching spring of predetermined inner and outer diameter is provided having a base end fixed to the spring support base and extending outwardly therefrom to a switching end. A compressible coil capture spring of generally conical configuration having a constricted connecting end of first predetermined inner diameter is connected to and extends from the diode second electrode pin mounting portion and further extends within the switching spring to a wider capture end of second inner and outer diameter selected for receiving the battery rod-shaped electrode.

Another feature of the invention provides an illuminated implement including a body component having an internally disposed chamber extending along a given axis between an illuminating first end and an oppositely disposed second end. A battery having an electrode defining outer surface of given outer diameter and a centrally disposed rod-shaped electrode extending outwardly from the forward face thereof is provided. This battery is located within the chamber in a manner wherein the electrode extends toward the illuminating first end and substantially along the given axis. A compressible coil switching spring is located within the chamber and has a given inner diameter and an outer diameter selected for abuttable electrical engagement with the battery outer surface at the forward face and is positioned over and in non-contacting relationship with the centrally disposed rod-shaped battery electrode and further has a base end facing the chamber first end. A light emitting diode is located at the chamber illuminating first end and has first and second electrode pins extending from a back surface thereof, the first pin extending rearwardly from the back surface to a base position and being configured thereat to define a spring support base disposed along a plane generally parallel with the back surface and having an opening therein. The base is in electrical contact with the switching spring base end. The second pin is configured to extend to the base opening and provide a mounting portion thereat substantially aligned with the axis. A compressible coil capture spring of generally conical configuration is provided having a connecting and electrically coupled and mounted to the second pin mounting portion, and is extensible in non-contacting relationship within the switching spring to a wider capture end of inner diameter selected for receiving the battery electrode in electrical contacting association. An actuator arrangement is provided which selectively effects the mechanical capture and electrical coupling of the end of the battery rod-shaped electrode and the capture spring through relative movement between the diode and battery effecting the compression of the switching spring.

Another feature of the invention provides a method for making an illuminator assembly for use with a battery having an electrode defining outer surface of given outer diameter and a centrally disposed rod-shaped electrode extending outwardly from the forward face, comprising the steps of:

providing a light emitting diode having a diode portion with a rearward face and first and second electrode pins extending therefrom;

cutting the first electrode pin to a predetermined length effective to form a spring support base at a base location;

cutting the second electrode pin to a predetermined length effective to provide a centrally disposed mounting portion;

bending the second electrode pin to position the mounting portion centrally of the diode portion;

bending the first electrode pin at the base location to form the spring support base within which a base opening is provided through which the second electrode pin extends;

providing a compressible coil capture spring of generally conical configuration having a connecting end of predetermined internal diameter and an oppositely disposed capture end of predetermined outer diameter and dimension to receive the rod-shaped electrode;

attaching the capture spring connecting end to the second electrode pin mounting portion;

providing a compressible coil switching spring having an inner diameter greater than the capture spring capture end outer diameter;

positioning the switching spring substantially over the capture spring; and attaching one end of the switching spring to the spring support base.

Other objects of the invention will, in part, be obvious and will, in part, appear hereinafter.

The invention, accordingly, comprises the apparatus and method possessing the construction, combination of elements, arrangement of parts, and steps which are exemplified in the following detailed disclosure. For a fuller understanding of the nature and objects of the invention, reference should be had to the following detailed description taken in connection with the accompanying drawings.

DETAILED DESCRIPTION

To facilitate the description to follow, the illuminator assembly of the invention initially is described in conjunction with its application to recreational darts. The discourse then turns to a detailed description of the illuminator assembly itself and a technique for carrying out its fabrication at high volume production levels. The description then looks to a variety of exemplary applications or illuminated implements with which the illuminator assembly may be employed.

Figure 1:
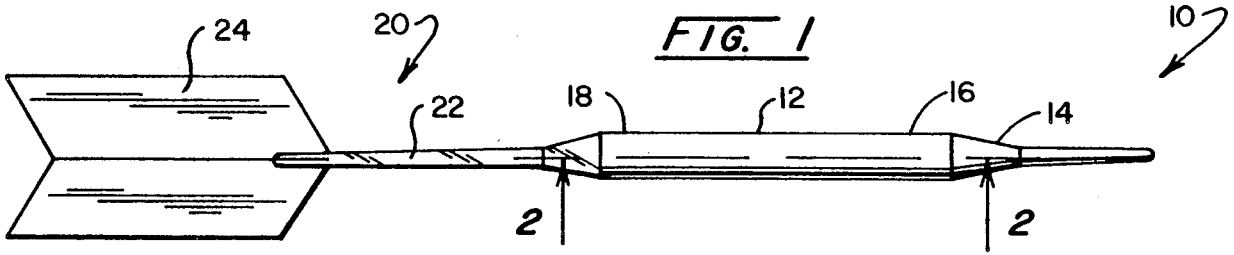
FIG. 1 is a side elevational view of a recreational dart incorporating an illuminator assembly according to the invention.

Referring to FIG. 1, a recreational dart is revealed generally at 10, the embodiment shown being referred to in the industry as a "soft tip" dart. Such soft tip darts as at 10 generally will have a lesser overall weight than conventional "hard tipped" darts inasmuch as they are employed with automatic scoring dart board which would be injured if used in conjunction with heavier hard tip darts. The application herein, however, is one wherein the dart which incorporates the illuminator features of the invention may be either hard tipped or soft tipped. Dart 10 is seen to have a cylindrical thin elongate body component 12 which typically will be formed of a metal carrying some form of external ornamentation. The point of the dart at 14 is replaceable and conventionally is threadably engaged with the end 16 of dart 10. The rearward or illuminating end of the dart 10 at 18 is shown threadably receiving a flight represented generally at 20 and including a light transmitting clear plastic stem 22 which supports feathers 24. An LED positioned at the end 18 of the device 10, when illuminated, will, in turn, transmit light along the stem 22 which may be reflected or otherwise disposed of to give the dart a "tracer like" appearance as it progresses toward a target dart board.

Figure 2:
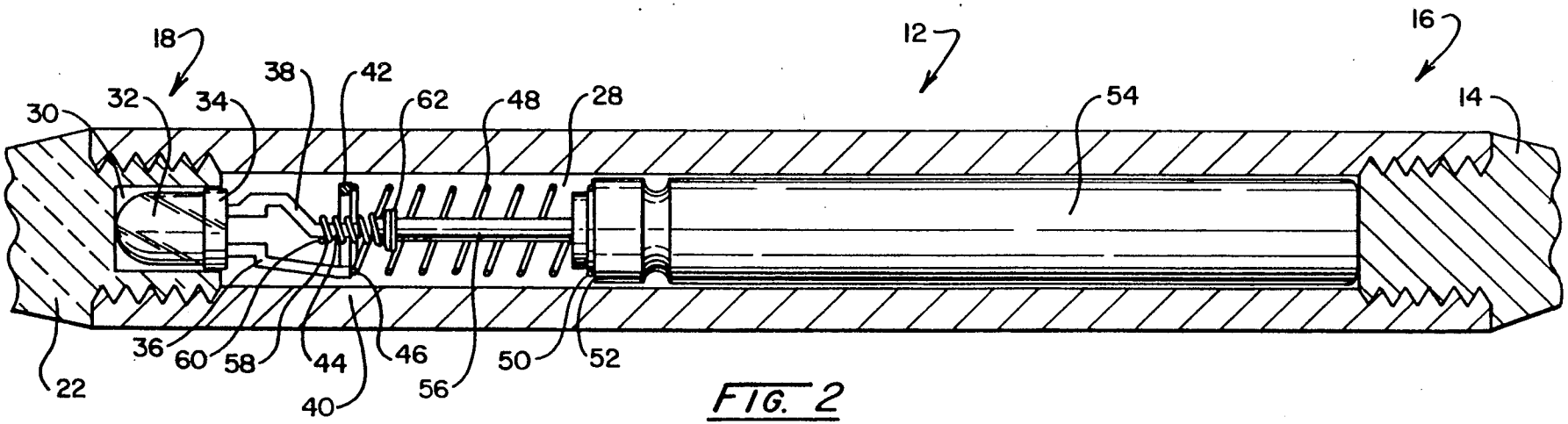
FIG. 2 is a sectional view of the body component of the dart of FIG. 1 taken through the plane 2—2 in FIG. 1.

Looking to FIG. 2, a sectional review of the body component 12 reveals an internally bored chamber 28 which is positioned coaxially with the central axis of body component 12. It may be observed that the point 14 is threadably engaged with the end portion 16 of component 12, while the stem 22 of flight 20 is shown fully threadably engaged with illuminating end 18 of the component 12. Stem 22 may be seen to be formed having an opening 30 therein which receives a light emitting diode (LED) 32. Alternatively, no such opening as at 30 is required. LED 32 preferably is provided as formed utilizing a double heterojunction (DH) AlGaAs/GaAs material technology. For example, the LEDs exhibit a high output efficiency over a wide range of drive currents. One such LED is a type HLMP K105 having a minimum axial luminous intensity at 25° C. of 35 MCD at 20 mA and a typical output of 65 MCD at 20 mA. The device also exhibits a viewing angle of about 45°. LEDs as at 32 are marketed, for example, by Hewlett Packard Corporation. Extending from the back surface 34 of LED 32 are two thin metal electrode pins 36 and 38. Pins 36 and 38 may have a square cross section having a principal dimension or diametric dimension, for example of about 0.025 inch. Electrode pin 36 is shown extending rearwardly from the back surface 34 to a base position 40 and is configured thereat to define a generally circular spring support base 42. The base 42 is disposed along a plane generally parallel with the back surface 34 of LED 32 or perpendicular to the central axis of the body component 12. Electrode pin 38 is configured such that it extends to provide a mounting portion 44 which is coaxial with the axis of body component 12 and which extends to the center of a base opening within support base 42. To the outwardly facing circular surface of spring support base 42 there is connected the base end 46 of a compressible coil switching spring 48. Preferably, the base end 46 of spring 48 may be connected to spring support base 42 by soldering or spot welding o provide both an assemblage rigid connection and an assured electrical coupling. To facilitate this connection, practitioners may find it desirable to form the spring 48 such that the base end 46 thereof includes one or more closed coils. Spring 48 may be provided as a carbon steel wire having a spring rate ranging from about 0.24 lbs/inch to 0.96 lbs/inch. For most applications, spring rate of about 0.48 lbs/inch will be found desirable. Similarly, for a large variety of implementations, a retractability or compliance in compression of 0.30 inch is desirable. The switching end 50 of spring 48 is seen to be abuttably engaging the forward face 52 of a lithium pin battery 54. Battery 54 is configured having an external surface electrode which extends partially over the forward face 52 thereof so as to provide an electrical contact with the switching end 50 of spring 48. Extending from the center of battery 54 is a rod shaped electrode 56 which, for the type battery illustrated is the cathode of the device. For the application shown, the battery 54 may be provided, for example, as a type BR435 marketed by the Battery Sales Division of Panasonic Industrial Company, Division of Matsushita Electric Corporation of America. The battery has a nominal voltage of 3 volts and a nominal capacity of 50 mAh, a diameter of 4.2 mm, a height of 35.8 mm, and a weight of 0.92 g. Note that the battery 54 slideably nests within the chamber 28 and that its outside diameter is essentially the same as the corresponding outside diameter of switching spring 48. No permanent connection is made between the forward face 52 of battery 54 and the switching end of spring 48, thus permitting battery replacement for the device 10. However, a desirable compression based electrical contact is provided between end 50 and face 52.

Rod shaped electrode 56 is seen extending to and in engagement with the wider open end of a compressible coil capture spring 58. Spring 58 may be formed, for example, of phosphor-bronze wire and has a generally conical configuration with a constricted connecting end 60 and a wider diameter capture end 62. Practitioners may find it desirable to provide the capture end 62 of spring 58 having closed coils as shown. The connecting end 60 of spring 58 is fixed to mounting portion 44 of electrode pin 38. Preferably, this connection is assured by soldering. In general, the inner diameter of connecting end 60 will correspond with the principal dimension of electrode pin 38, for example about 0.025 inch. Spring 58 is seen to extend through the opening of base 42 formed from lead 36 to present the capture end 62 thereof at a location within spring 48 selected to permit reception of the end of rod shaped electrode 56 of battery 54. In the configuration thus shown, the electrical circuit of the assemblage is closed and LED 32 will be illuminated. The switching for this embodiment is carried out, for example, by the act of screwing flight stem 22 into the end 18 of body component 12 to thus move LED and its associated configuration toward battery 54 and cause the capture and engagement of rod-like electrode 56 with the capture spring 58. Note that as the stem 22 is engaged within the end portion 18, the assemblage compresses spring 48 against the face 52 of battery 54. Battery 54, in turn, is restrained from movement by virtue of its abutting contact with internally disposed surface of tip 14. Of course, switching can be carried out by the tightening of tip 14 as the stem 22 is fully inserted, a relative motion being all that is required. Thus, a very simple switch actuation is accomplished with no external switches required and with a high level of reliability particularly suited for the rigorous dynamic environment of a recreational dart.

Figures 3, 4, 5, 6, 7, 8, 9:
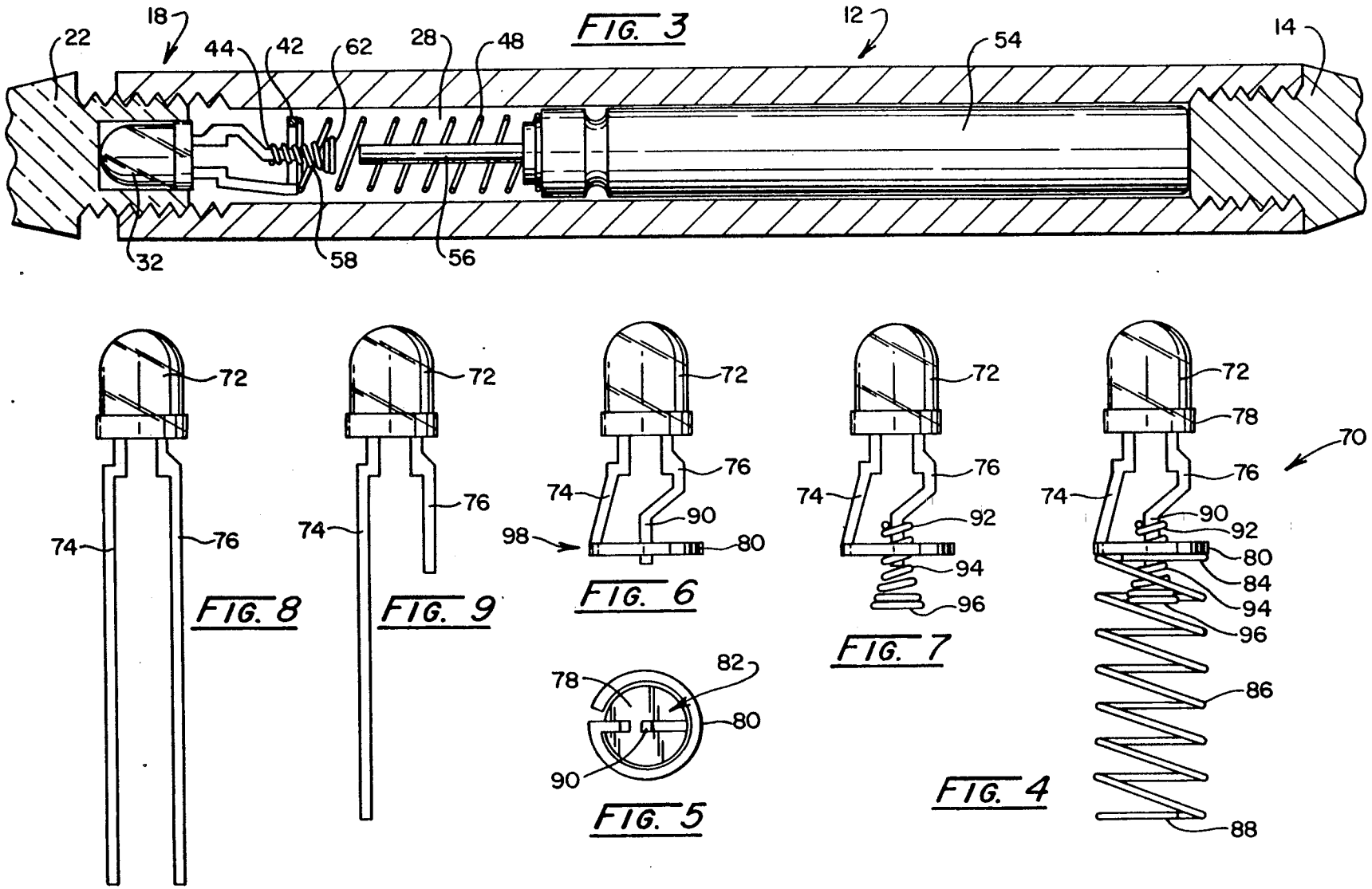
FIG. 3 is a reproduction of FIG. 2 but showing the illuminator assembly therein in an open circuit configuration.
FIG. 4 is an elevational view of an illuminator assembly according to the invention.
FIG. 5 is a bottom view of a portion of an illuminator assembly according to the invention.
FIG. 6 is an elevational view of a portion of an illuminator assembly according to the invention prior to the attachment of springs thereto.
FIG. 7 is an elevational view of the assembly shown in FIG. 6 with the addition of a capture spring thereto.
FIG. 8 is a side elevational view of a light emitting diode prior to a manufacturing procedure wherein the electrode pins thereof are cut.
FIG. 9 is a side elevational view of the diode of FIG. 8 following a step of cutting the electrode pins thereof.

Now looking to FIG. 3, the cross section represented in FIG. 2 is reproduced but in an open switch or open circuit configuration. Note that the stem 22 of flight 20 has been partially threadably unscrewed from illuminating end 18 of body component 12. This action permits the switching spring 48 to expand or recover to urge the LED 32 and capture spring 58 to move axially rearwardly and effect the disengagement of rod-like electrode 56 of battery 54 from capture spring 58. The circuit is open and off mode switching thus is accomplished with highly desirable simplicity. The utilization of the spring circuit-switching assembly disclosed is highly electrically efficient and quite inexpensive. Additionally, the illuminator assemblage provided is amenable to desired high volume production procedures. Where the dart 10 is of a hard point variety, then, the formation of chamber 28 therein, for conventional materials would render the dart somewhat light for competitive dart throwing. However, the desired weight of dart 10 with the hard point may be regained by forming the body component 12 of depleted uranium. This material heretofore has found little use in the industry, being used principally, for example, as armour piercing material for implements of war. However, depleted uranium has a density which will achieve a desired dart 10 weight, for example of above about 26 g. The density of this material is in excess of about 18 grams per cubic centimeter.

Turning to FIG. 4, the illuminators assembly, per se, of the invention is revealed generally at 70. In the figure, the LED is shown at 72 having electrode pins 74 and 76 extending from the back surface 78 thereof. Electrode pin 74 is configured to provide a circular spring support base 82 which, as revealed in FIG. 5, is of circular configuration to provide a base opening 82. Returning to FIG. 4, secured to the spring support base 80 is the base end 84 of a compressible coil switching spring 86 which extends along the central axis of the assembly 70 to a switching end 88. FIGS. 4, 5, and 6 reveal the mounting portion 90 of electrode pin 76 to which the connecting end 92 of a conically shaped compressible coil capture spring 94 is attached (see FIG. 7). Spring 94 extends in conical fashion to capture end 96 which may be provided, for example, with a closed coil configuration to facilitate the capture of the rod electrode of a battery as earlier described at 54.

The general procedure for fabricating the assembly 70 is shown commencing with FIG. 8 wherein LED 72 is revealed having electrode pins 74 and 76 extending therein to their normal extent as received from the supplier. FIG. 9 reveals a next fabrication procedure wherein these electrode pins 74 and 76 are cut to lengths appropriate for their subsequent manipulation. Then, as represented in FIG. 6, the spring support base 80 is configured at base position 98 and the electrode lead 76 is bent or configured to provide a mounting portion 90 extending through the opening 82 formed by spring support base 80 (see FIG. 5). The connecting end 92 of capture spring 94 then is attached to mounting portion 90 of electrode pin 76 and is soldered in place, for example, using a conventional lower temperature solder such as tin-lead. Next, as represented in FIG. 4, the base end 84 of switching spring 86 is attached to spring support base 80, preferably by soldering using the noted lower temperature solder.

Figure 10:
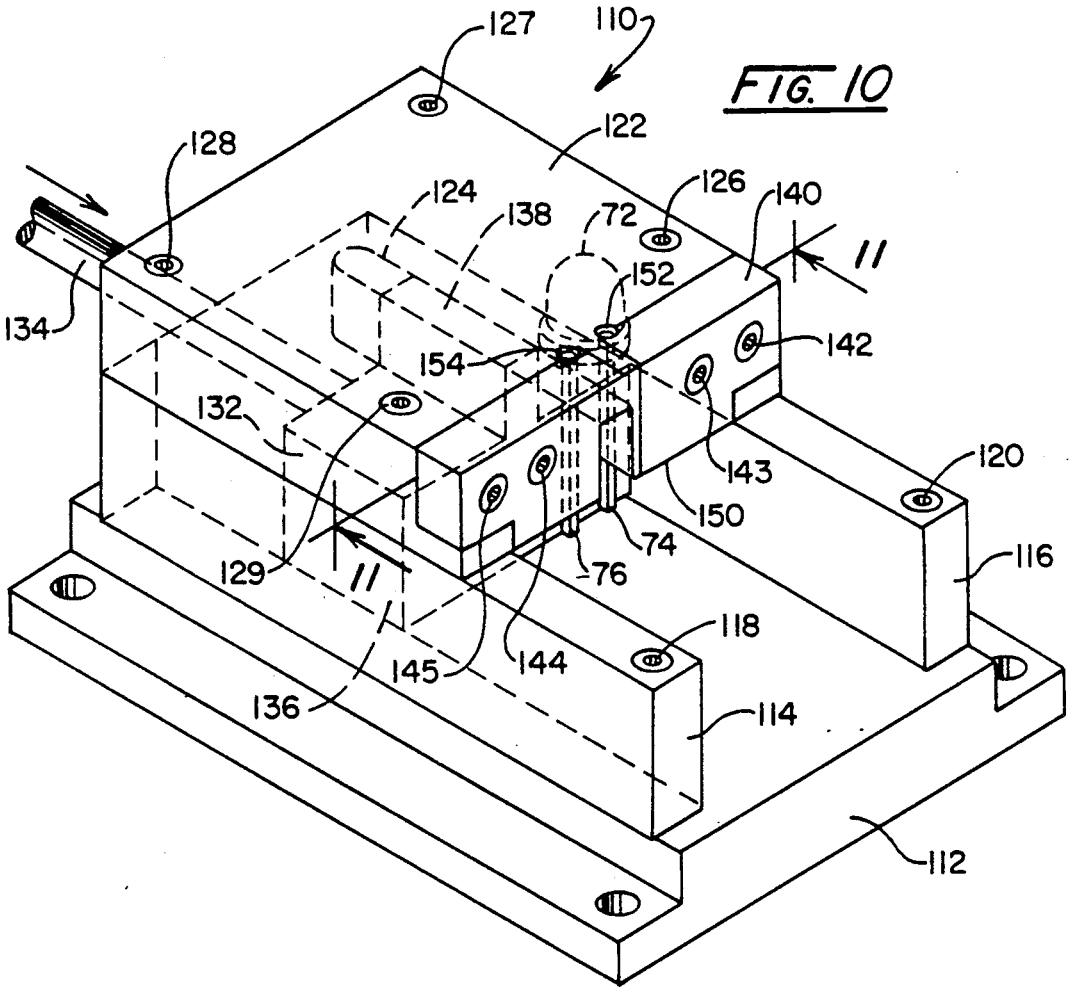
FIG. 10 is a perspective view of a cutting device for cutting the electrode pins of an LED to the shape represented in FIG. 9.
Figure 11:
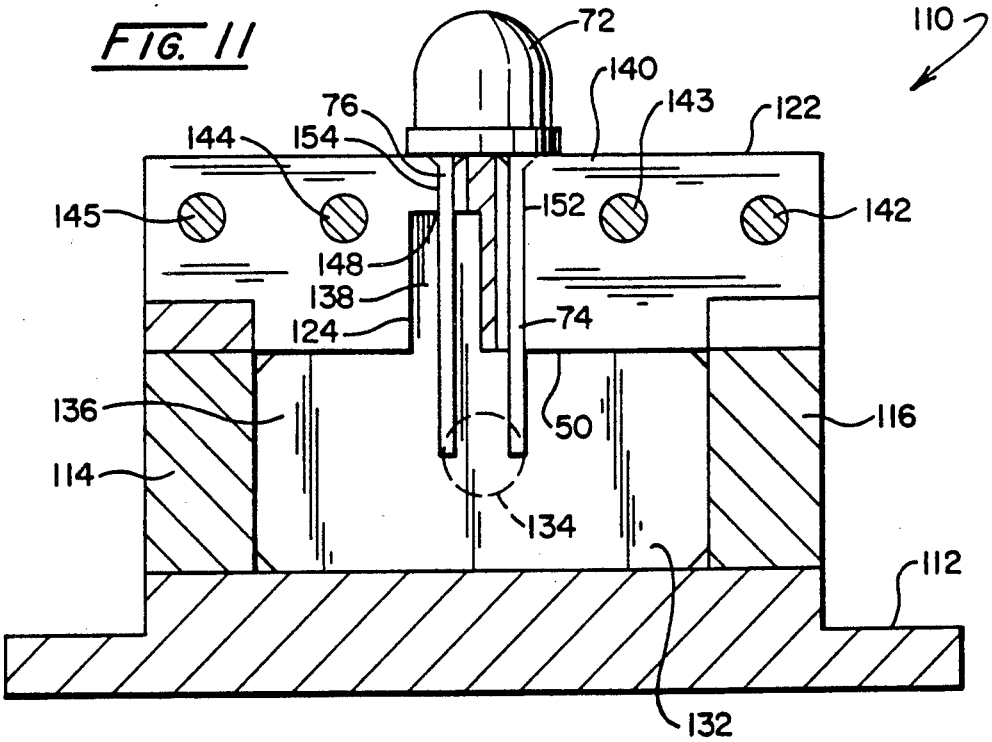
FIG. 11 is a sectional view of the device of FIG. 10 taken through the plane 11—11 shown therein.

Referring to FIGS. 10 and 11, a manufacturing jig which may be employed in configuring the pin leads 74 and 76 of LED 72 to the length represented in FIG. 9 is represented generally at 110. The device 110 is shown having a base 112 to which are attached two parallel guideway components 114 and 116. These components are retained upon base 112, for example, by machine screws as represented at 119 and 120. Attached, in turn, to the top of components 114 and 116 is a top guide block 122 which is configured having an off center guide slot 124 formed therein. The block 122 is affixed to components 114 and 116, for example, by machine screws 126–129. Slideably movable within the assemblage thus formed is a pusher block 132 which is reciprocably driven by a cylinder, the rod for which is represented at 134. Block 132 is configured having a lower rectangular portion 136 and an integrally formed upstanding portion 138 which rides within guide slot 124. Positioned at the front face of top guide block 122 is a knife block 140 which is retained in position by machine screws as at 142–145. The upper inwardly disposed edge of block 140 at a slot 148 shown therein is provided as a sharp blade edge, while, correspondingly, an inwardly disposed lower edge at surface 150 thereof forms a next cutting edge. LEDs as at 72 are positioned upon the assembly 110 such that lead pins 74 and 76 extend through appropriately positioned slots 152 and 154 formed within knife block 140. As revealed in FIG. 11, as the pusher block 132 is driven forwardly, the electrode pins 74 and 76 are pushed against the appropriate knife edges at slot 148 and surface 150 to form the LED 72 structure represented in FIG. 9. Following cutting, rod 134 withdraws the pusher block 132 to commence a next cutting operation.

Figure 12:
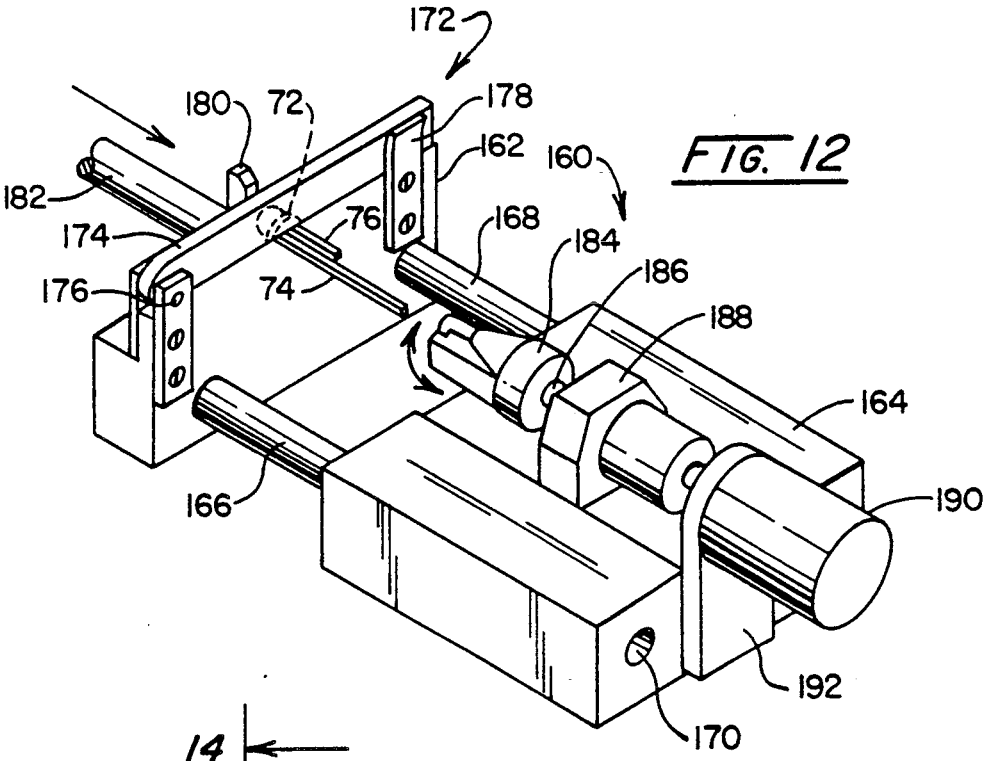
FIG. 12 is a perspective view of a pin forming die assembly which may be employed in forming the structure of FIG. 6 from the structure of FIG. 9.

Referring to FIG. 12, a pin forming assembly for deriving the LED 72 configuration shown in FIG. 6 is revealed generally at 160. Assembly 160 includes a ram block 162 which is slideably connected to a base 164 by rods 166 and 168. These rods ride, for example, in bores, one of which is represented at 170. Block 162 further supports a clamping mechanism represented generally at 172 which includes a hinged clamping bar 174 which is pivotally mounted to block 162 at a pin 176 and which functions to retain LED 72 in position as shown when pivoted downwardly to be engaged by clamp retainer 178. Leads 74 and 76 of the LED 72 are retained in position by slots (not shown) within block 162 and the LED itself is positioned and secured by virtue of its abutment with a retainer 180. A cylinder driven rod to which the retainer 180 is affixed, moves the block 162 assemblage toward base 164 upon mounting the LED 72 therein as shown.

At base 164 there is mounted a rotatable forming die 184, which, in turn, is rotationally supported from a shaft 186 extending through and supported by a bearing block 188. Cap 186, in turn, is driven by an electric motor 190 supported from base 164 by plate 192.

Figure 13:
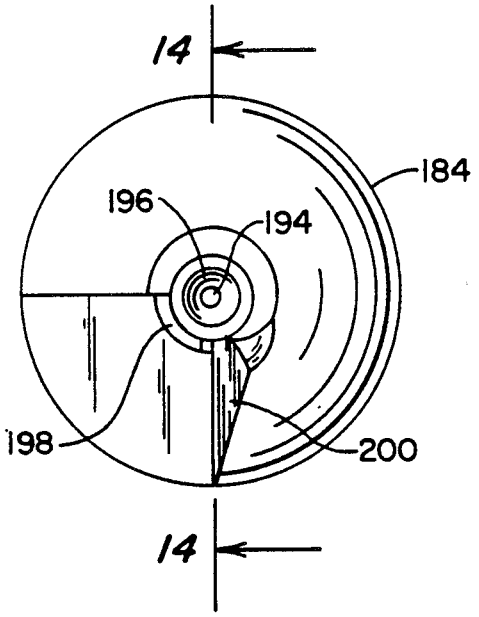
FIG. 13 is a front view of a nose component of the die assembly shown in FIG. 12.
Figure 14:
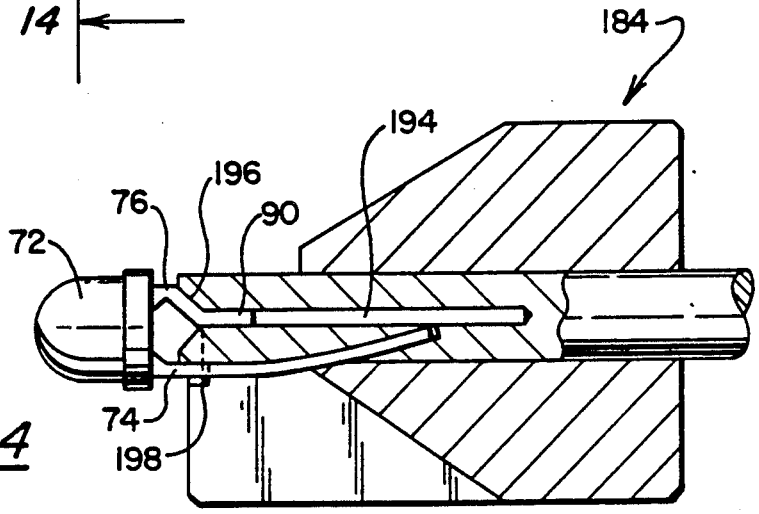
FIG. 14 is a sectional view taken through the plane 14—14 shown in FIG. 13.

FIG. 13 reveals that the forming die 184 is configured having a centrally disposed bore 194 formed therein and extending from a conical forming surface 196. Thus, as the LED 72 is moved into the die 184, shorter lead 76 is maneuvered into bore 194 and is formed or bent so as to be positioned centrally of the diode 72 structure. Simultaneously, the electrode pin 74 enters a slot 198 as shown in FIGS. 13 and 14. Slot 198 communicates with a ramp shown in FIG. 13 at 200. When this insertion is completed, the die 184 is rotated by motor 190 and the ramp 200-slot 198 combination serves to form the circular spring support base 80 as shown in FIG. 6 in the course of 360° of revolution.

Figure 15:
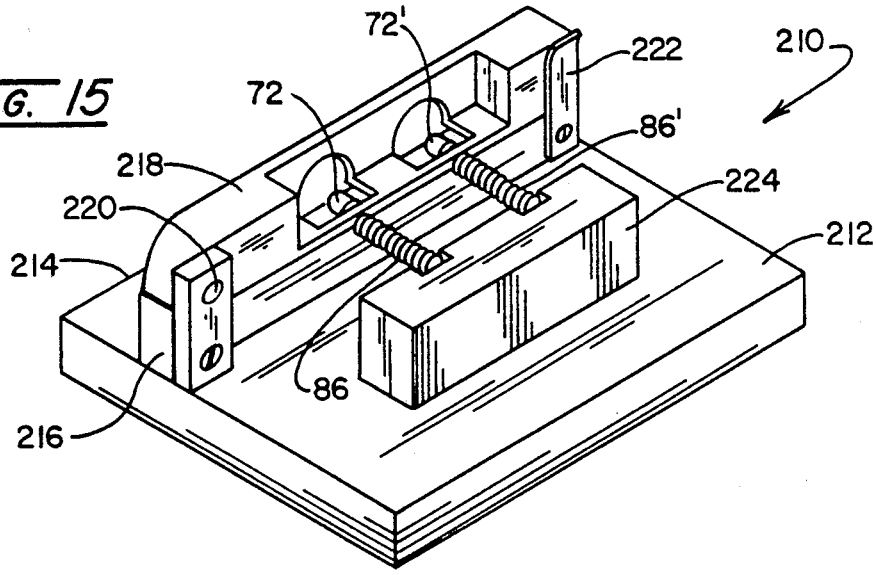
FIG. 15 is a perspective view of an assembly jig employed in attaching springs to the structure shown in FIG. 7.

Referring to FIG. 15, an assembly jig for attaching springs 86 and 94 to the LED 72 structure revealed in FIG. 6 is shown. The assembly jig 210 includes a base 212 having a clamping mechanism represented generally at 214 fixed thereto. The mechanism 214 includes an LED receiving block 216 to which a pivotal clamp bar 218 is attached by pivot connection at pivot pin 220. The clamp bar 218 is retained in clamping orientation by a clamp retainer 222. LEDs as at 72 and 72' are shown retained by this assembly 214 and, initially, the capture springs 94 are soldered thereto. Following this attachment of the clamping springs, the switching springs as shown at 86 and 86' are positioned and appropriately located by locating block 224 and then soldered to spring support bases as at 80. The illuminator assembly 70 as shown at FIG. 4 is then completed.

Figure 16:
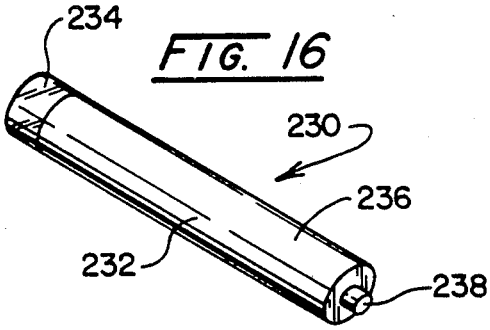
FIG. 16 is a perspective view of a flashlight-type implementation of the illuminator assembly of the invention.

The illuminator assembly 70 has a myriad of uses in developing illuminated implements which are limited only by the imagination of those having access to it. For example, in FIG. 16, a small flashlight is revealed at 230 having a body component 232 extending to a transparent illuminating end 234 and having a fixed plug retaining opposite end 236 with a small piston like plunger 238 extending therefrom which communicates to the rearwardly disposed end of the elongate battery used with the assemblage. Thus, the LED as at 72 is stationary and the battery is moved to compress the switching spring 86 for this embodiment. Plunge 238 is automatically returned by that same spring.

Figure 17:
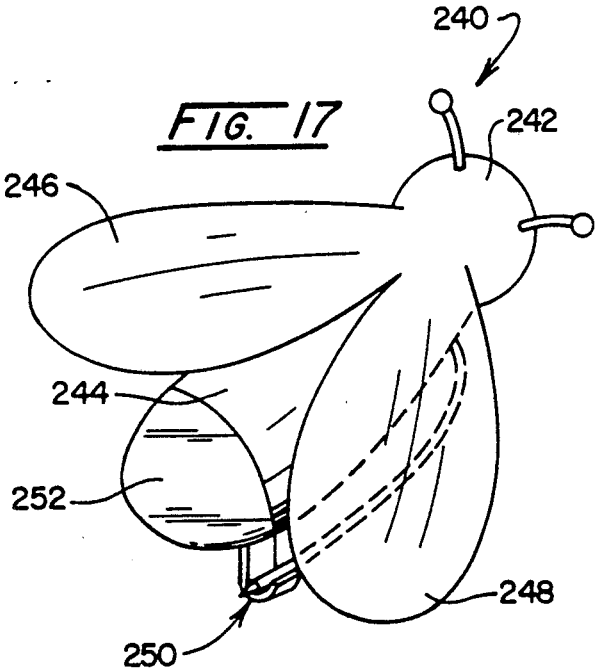
FIG. 17 is a perspective view of a novelty pin implementation of the illuminator assembly of the invention.

FIG. 17 shows an ornamental bug 240 having a head 242 formed as part of a body component 244 and further incorporating such elements as wings 246 and 248 and a clasp represented generally at 250. The illuminating end of body component 244 is provided as a transparent end 252 which is threadably engaged with body component 244 and, in the same manner as the dart embodiment herein, upon being screwed in, causes the compression of switching spring 86 and the movement of components together to provide an illumination in firefly fashion at tip 252.

Figure 18:
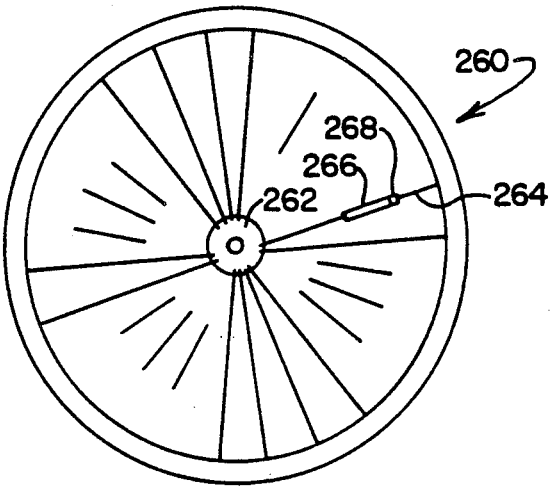
FIG. 18 is a bicycle illuminator implementation of the illuminator assembly of the invention.

FIG. 18 shows a bicycle wheel 260 having a hub 262 and spokes, one of which is shown at 264. Upon the spoke 264 there is positioned a small body component 266 having an illuminating end 268 and, instead of a plunger as at 238 in FIG. 16, a weight is incorporated within the opposite end of body component 266, to centrifugally move the battery outwardly and effect compression of switching spring 86 and movement into an on or circuit completing orientation.

Figure 19:
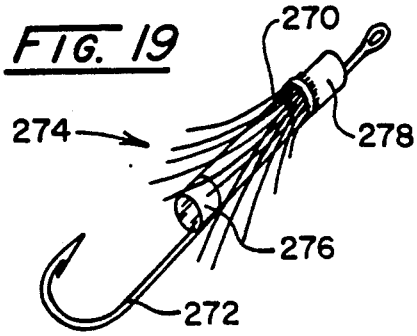
FIG. 19 is a fishing lure implementation of the illuminator assembly of the invention.

Looking to FIG. 19, a miniature illuminator of generally cylindrical configuration is shown coupled to a fish hook 272. Bait feathering as at 274 is shown schematically to represent the formation of a lure. The body component 270 is provided with a transparent illuminating end 276 and a threadably engaged opposite end 278. By threadably securing the tip 278 within the body component 270, the illuminator assemblage is secured against water incursion and is turned on. The degree of miniaturization available with the illuminator assembly 70 is revealed by the embodiment of FIG. 18. Because no external switching is required of the device, the illumination feature can be provided in devices which are immersed.

Since certain changes may be made in the above-described apparatus and method without departing from the scope of the invention herein involved, it is intended that all matter contained in the description thereof or shown in the accompanying drawings shall be interpreted as illustrative and not in a limiting sense.

I claim:

1. The method for making an illuminator assembly for use with a battery having an electrode defining outer surface of given outer diameter and a centrally disposed rod shaped electrode extending outwardly from said forward face, comprising the steps of:

providing a light emitting diode having a diode portion with a rearward face and first and second electrode pins extending therefrom;

cutting said first electrode pin to a predetermined length effective to form a spring support base at a base location;

cutting said second electrode pin to a predetermined length effective to provide a centrally disposed mounting portion;

bending said second electrode pin to position said mounting portion centrally of said diode portion;

bending said first electrode pin at said base location to form said spring support base within which a base opening is provided through which said second electrode pin extends;

providing a compressible coil capture spring of generally conical configuration having a connecting end of predetermined internal diameter and an oppositely disposed capture end of predetermined outer diameter and dimensioned to receive said rod-shaped electrode;

attaching said capture spring connecting end to said second electrode pin mounting portion;

providing a compressible coil switching spring having an inner diameter greater than said capture spring capture end outer diameter;

positioning said switching spring substantially over said capture spring; and attaching one end of said switching spring to said spring support base.

2. The method of claim 1 wherein said step for cutting said second electrode pin provides a said predetermined length effective to position said mounting portion through and beyond said base opening.

3. The method of claim 1 in which said step for bending said first electrode pin forms said spring support base as a circle along a plane parallel to said diode portion rearward face.

4. The method of claim 1 in which said step for attaching said capture spring connecting end to said second electrode pin mounting portion is carried out by soldering.

5. The method of claim 1 in which said step for attaching said switching spring to said spring support base is carried out; by soldering.

* * * * *